US006094524A

United States Patent [19]

Riley

[11] Patent Number: 6,094,524

[45] Date of Patent: Jul. 25, 2000

[54] HOT WATER DISPENSER SYSTEM

[75] Inventor: Wayne C Riley, Sturtevant, Wis.

[73] Assignee: Emerson Electric Co., St. Louis, Mo.

[21] Appl. No.: 09/026,070

[22] Filed: Feb. 19, 1998

[51] Int. Cl.[7] ..... F24H 1/10; H05B 3/78

[52] U.S. Cl. ..... 392/485; 392/441

[58] Field of Search ..... 392/485, 449–452, 392/441

[56] References Cited

U.S. PATENT DOCUMENTS 3,793,934 2/1974 Martin ..... 99/282

4,263,498 4/1981 Meyers ..... 392/451

*Primary Examiner*—Teresa Walberg

*Assistant Examiner*—Thor Campbell

*Attorney, Agent, or Firm*—Ryan Kromholz & Manion, S.

[57] ABSTRACT

A hot water supply system has a tank divided into a water heating chamber and a vented expansion chamber. A venturi orifice inlet is connected through a faucet valve to a cold water supply and the outlet of the orifice emits a high velocity jet at a negative pressure to cause water to be aspirated from the expansion chamber and mix with the supply water jet for pressurizing the heating chamber to cause hot water to be dispensed from the faucet spout, connected to the tank heating chamber, when the valve is opened. An air collection chamber receives the supply water jet stream which flows into the heating chamber until the expansion chamber is emptied of water for air to be aspirated into the collection chamber in which case the jet is disrupted and aspiration of air stops although the flow of water into and out of the heating tank can continue as long as the faucet valve remains open.

5 Claims, 1 Drawing Sheet

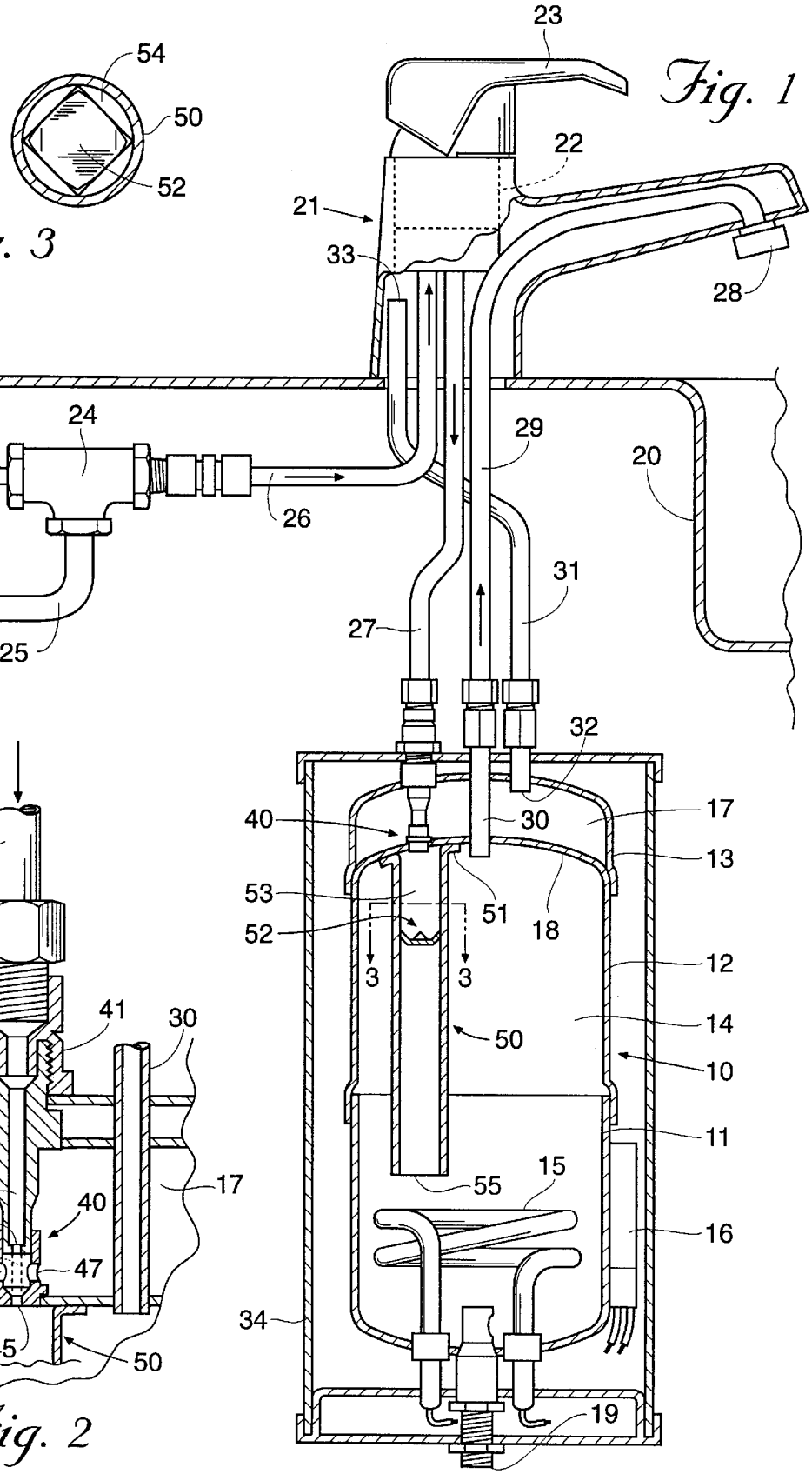
Fig. 1
Fig. 3
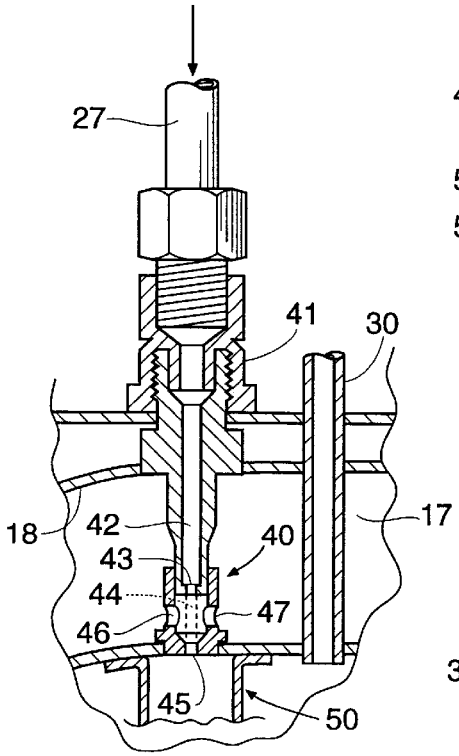
Fig. 2

HOT WATER DISPENSER SYSTEM

BACKGROUND OF THE INVENTION

The invention disclosed herein pertains to a system wherein hot water is dispensed from a faucet substantially coincidentally with opening of the faucet.

Systems for heating and dispensing hot water instantly are basically known. "Hot" as the term is used in this case means water at a temperature of about 190° F. (88° C.) or slightly higher but always below the boiling point. Water at this high temperature is usually made available at a dedicated faucet for individuals who need hot water to make instant coffee, tea or cocoa, for example. A typical preexisting system heats water in a relatively small capacity tank which is situated below the sink on which the faucet is mounted. The tank may have a capacity of ⅓ or ½ gallons (1.3 or 1.9 liters). The tank is divided into two chambers, a main chamber in which water is heated electrically and an expansion chamber that is contiguous with the main chamber and into which water being heated in the main chamber is allowed to expand. The tank is vented to the atmosphere to preclude build up of pressure in the tank which is necessary because the tank usually has a thin wall which may even be a plastic material instead of metal.

Every time hot water is drawn from the tank, due to opening of the faucet, it is necessary to withdraw the hot water from the expansion chamber of the tank to provide for expansion of the replenishment cold water that is supplied to the main tank chamber from the building water system. Cold supply water is fed into the tank and hot water is drawn out of the expansion chamber concurrently with opening of the faucet using a venturi aspirator. When the faucet is opened it does not control dispensing of the hot water directly but, instead, it supplies cold water at the bottom of the tank to thereby force hot water out at the top of the tank at a spout under moderate pressure.

In hot water dispenser systems the venturi aspirator jet or orifice may be in the hot water feed out of the tank or the cold water feed into the tank, each of which has advantages and disadvantages. With the aspirator in the cold water supply the venturi jet orifice inlet is fed cold supply water when the valve in the faucet is opened. As a result, a fine high velocity venturi jet is emitted from the outlet of the orifice. As is characteristic of a venturi jet, as velocity of the jet stream increases the pressure of the stream or jet in the orifice becomes negative relative to the pressure of the water to which the lateral holes of the aspirator body is exposed. In this case the lateral holes communicate with the hot water in the expansion chamber of the tank so hot water for the expansion chamber and the cold supply water fed through the orifice are projected into the main chamber of the tank to thereby force hot water out of the tank to the faucet spout. Because most of the cold supply water line pressure is dropped across the venturi, the pressure of the water in the main chamber of the tank never can reach supply line pressure. This is advantageous since it makes possible a simpler and low pressure tank design.

The problem with having the venturi in the cold water infeed to the venturi jet orifice is that in prior designs when the level of the water in the expansion tank drops to below the level of the side holes in the aspirator body, air is drawn through the tank vent line and the expansion chamber. When the aspirator injects air into the cold incoming jet stream water, the aerated water flows into the tank, causing mixing of hot and cold water which results in poor water delivery. The aerated water stream also results in air bubbles collecting in the tank, causing excessive spitting and sputtering as the water discharges from the spout of the faucet.

It will be evident that a cold side aspirator system needs a means to accomplish aspiration of water from the expansion chamber of the tank but that also prevents aspiration of air to the extent that air begins to mix with the heated water. The most usual attempt to solve the air intake problem has been to use a float device that follows the water level in the expansion chamber and blocks the aspirator body side hole when the water level drops. Using a float device is not a satisfactory solution, however, because such devices use moving parts which are vulnerable to failure due to wear and clogging by mineral deposits from the water.

In the alternatively available hot side system the cold supply line water is fed directly into the bottom region of the main chamber of the tank to pressurize the tank. In this case the pressure of the hot water in the main tank is applied to the infeed end of the venturi orifice to produce the jet and effect the negative pressure that is necessary to aspirate the hot water from the expansion chamber of the vented tank. As implied above, with the venturi in the hot side the tank must be designed to withstand water line pressure because when the faucet is operated and the valve in it is opened the cold replenishment water is fed directly from the building supply line through the valve into the tank. This increases the cost of the tank because of the high pressure withstand requirement.

SUMMARY OF THE INVENTION

An objective of the invention is to provide an instant hot water dispenser system which uses and preserves the advantages of having the venturi aspirator jet orifice connected to cold water supply line through a faucet valve so tank pressure is lower than supply line pressure and also prevents air from being injected into the heating chamber even when the expansion chamber is completely emptied of water by the aspirator without resorting to using any moving parts.

According to the invention, cold side aspiration is employed. The aspirator body is positioned in a wall that separates the main hot water chamber of the tank from the contiguous expansion chamber above it. A tube leads from the faucet valve to provide supply water at building mains pressure to the infeed end of the venturi jet orifice whenever the faucet is operated to draw hot water from the faucet spout. The negative pressure developed by the resulting venturi jet relative to the expansion chamber causes aspiration of hot water from the expansion chamber so a jet stream mixture of hot and cold water is projected from the venture orifice. However, the water jet does not go directly into the main water heating chamber as it does under prior practice, but instead, according to the invention, it goes into and through a tubular air collection chamber that extends into the main water heating chamber of the tank. Now when the expansion chamber is emptied of water and air begins to be aspirated from it, a quantity of air is captured in the collection chamber. Because the collection chamber is submerged in the water heating tank chamber full of water, any air collected in the chamber is subject at its lower open end to hydrostatic pressure from the water. As the column of air collects in the chamber, the air pressure increases and counters the negative pressure developed by the venturi jet. The aspiration of air from the expansion chamber slowly decreases with the increasing air pressure. The aspiration of air ceases when the air pressure equals the venturi pressure but supply water will still be fed as long as the faucet valve remains open.

How the foregoing objectives and other objectives are achieved will be apparent in the ensuing more detailed description of a preferred embodiment of the invention which will now be set forth in reference to the accompanying drawings.

DESCRIPTION OF THE DRAWINGS

FIG. 1 is a diagrammatic side elevational view of a hot water dispenser system, partly in section, incorporating the invention;

FIG. 2 is an enlarged sectional view of the venturi aspirator shown in FIG. 1; and FIG. 3 is a sectional view taken on a line corresponding to 3—3 in FIG. 1.

DESCRIPTION OF A PREFERRED EMBODIMENT

In FIG. 1, the tank for heating water is indicated generally by the reference numeral 10. The tank is comprised of three sections 11, 12 and 13 which are joined together by welding or other suitable means that results in a leakproof structure. The tank can also be molded of a suitable plastic having a gasketed cover, not illustrated, because according to the invention, pressure in the tank never equals the pressure of the cold water infeed line. Sections 11 and 12 are joined to produce a main chamber 14 in which heating of the water takes place. An electric heater element 15 is positioned near the interior bottom of main chamber 14. The heater element is not shown as being connected but its leads 15 extend into a controller 16 to which electric power is supplied. The temperature of the water is controlled in a conventional way with a thermostat which is not visible in the controller box. Typically, the water temperature would be held at around 190° F. (88° C.) but always below boiling temperature.

Tank 10 also has an expansion chamber 17 into which supply water that is heated in main chamber 14 can expand. A bulkhead 18 separates the main and expansion chambers from each other. The tank can be concealed in a housing 34 which endows the installation with better esthetic characteristics and prevents touching the hot tank. The tank is provided with a conventional draining device 19.

The tank 10 and its housing 18 are usually installed beneath a sink 20, a part of which is shown. A decorative faucet body 21 is mounted to the top of the sink. A supply water infeed valve is symbolized by the dashed lined rectangle 22. The valve 22 of the faucet is opened and closed by raising and lowering an operating handle 23. If cold water supply shutoff valve 24 is open, as is normally the case, opening of manually controlled faucet valve 22 will allow unheated supply water to flow from the building plumbing pipe 25 through faucet valve 24, tube 26, valve 22, and then to the tank by way of a tube 27. The flow direction of supply water to the tank is indicated by arrows as shown. Hot water is delivered to the spout outlet 28 of the faucet from the upper region of main tank chamber 14 by way of a tube 29 which has an extension 30 that passes through expansion chamber 17. The expansion chamber 17 is vented to the atmosphere by way of a tube 31 whose lower open end 32 is exposed to the interior of the expansion chamber 17 and whose upper end 33 is open to the atmosphere interiorly of faucet body 21. Besides preventing pressure above atmospheric pressure from developing in the expansion chamber 17, the vent also prevents a buildup of pressure above atmospheric pressure in the main tank chamber 14 for reasons which will be apparent later.

If no hot water is drawn from the tank for an extended period, the water in the main heating and expansion chambers 14 and 17, respectively, will be substantially evenly heated. When hot water is drawn from the tank it must necessarily be replenished with cold supply water for a new heating cycle. Inflow of cold supply water to the tank effectuates emptying of the expansion chamber 17 of water to provide a volume for incoming cold supply water to expand into as it is heated. Admitting replenishment supply water and emptying of the expansion chamber 17 concurrently is accomplished with a venturi aspirator 40 which is shown in FIG. 1 and is also shown in section and enlarged in FIG. 2. As shown, the venturi aspirator 40 is mounted in the bulkhead which constitutes the bottom of the expansion chamber 17. A coupling device 41 fastens the aspirator 40 sealingly to the tank as is shown in detail in FIG. 2. Cold supply water at mains pressure flows down bore 42 of the venturi device and imposes supply line pressure on the inlet end 43 of a venturi orifice 44 which is represented by dashed lines. Restricting the flow of the water by way of the small diameter orifice results in a velocity increase in the orifice and as a result a jet of water emerges from the exit end 45 of the orifice. Consonant with Bernoulli's principle, the increase in flow velocity in the orifice is accompanied by the pressure of the water becoming negative in the orifice relative to the pressure of the hot water in the expansion chamber 17. Consequently, hot water from the expansion chamber is drawn into the jet stream through side holes 46 and 44 of the aspirator and is discharged back into the main hot water chamber 14. The incoming stream of mixed hot and cold water, when discharged from the end 45 of the orifice is at a pressure well below supply line pressure but is still sufficiently high to force hot water out of main chamber 14 and up tube 29 for discharge from the faucet spout tip 28. Hot water gets into the expansion chamber 17 in the first place by expanding from the main water heating chamber 14 through the jet orifice 44 and the aspirator side holes 46 and 47 during times when water is being heated and is expanding between times when water is being withdrawn from the faucet spout opening 28.

Most of the concepts thus far described are known in the art. Now, however, attention will be focused on structure and functions that are provided, according to the invention, for overcoming the problems that arise when the water level in the expansion tank 17 drops to a level that is low enough for air to be drawn through the aspirator side holes 46 and 47 from the vented expansion tank. According to the invention, an air collector tube 50 is fastened sealingly at its top end 51 to the bulkhead 18 as shown in FIG. 1. When air begins to be injected into the air collector tube 50, the air begins filling the tube from the top. This tube is below the level of the water filling tank chamber 14 and as air is lighter than the water it is captured in the tube. As the collected air pushes against the weight of the water in the tank a positive pressure is developed in the air collection tube. As this pressure increases, with the column of air, its effect causes the venturi action of the aspirator 40 to decrease. When the tube is sufficiently full of air creating a sufficient pressure, the venturi action will cease. In illustrations where the supply water pressure is high, that is, substantially above 55 psi, the venturi jet velocity pressure could be high enough to drive collected air out of the bottom 55 of collector tube 50 and into the hot water chamber 14 which is not desired. This action is precluded in cases where it could occur by having a baffle 52 installed in the collector tube 50 for the venturi jet to impinge upon and dissipate its kinetic energy. As shown in FIG. 3, the baffle is mounted in tube 50 with bypass openings 54 around it so the jet stream water can flow into tank 14 until there is shutoff and so the tube 50 can be filled sufficiently deep with air at a pressure that will balance against the water pressure in the tank. By way of example and not limitation, a typical water pressure in the heating chamber may be 3 psi nd the air pressure in the collector tube 50 may be 3.1 psi at venturi jet shutoff. A commercial embodiment of the instant hot water dispenser, not shown, has hot water tank 14, expansion chamber 17, tube 50 and a cantilever supported baffle or bypassed deflector 52 all composed of plastic.

I claim:

1. A hot water dispensing system including:

a water heating chamber and an expansion chamber which is vented to the atmosphere and is in fluid flow communication with the heating chamber a heat source for heating water in said water heating chamber, a tubular member having an inlet in communication with said water heating chamber and having an outlet from which heated water is dispensed, a faucet valve having an inlet and an outlet for supply water, an aspirator device between said expansion chamber and said water heating chamber, the device including a body with a venturi orifice having an inlet coupled to said outlet for supply water and having an outlet for emitting a jet of supply water and air into said heating chamber when said faucet valve is opened, said body of the aspirator having at least one inlet hole for said expansion chamber to communicate with said venturi orifice for drawing fluids from said expansion chamber, and a vertically disposed air collection chamber sealingly connected to said aspirator body and arranged for receiving said jet of supply water and air emitted from the venturi orifice and conducting the supply water to said heating chamber for pressurizing the heating chamber sufficiently to enable said dispensing of heated water, and having a volume sufficient to retain a column of air drawn from the expansion chamber with a pressure which is sufficient to cause the venturi device to stop drawing air from said expansion chamber.

2. A hot water dispensing system according to claim 1, wherein said air collection chamber comprises a stationary baffle proximate to the exit end of said aspirator device, said baffle being arranged such that said jet of supply water and air impinges on said baffle and said baffle dissipates the kinetic energy of said jet of supply water and air to allow baffle and said baffle dissipates the kinetic energy of said jet of supply water and air to allow separation of said water and air and to prevent said air from exiting the bottom of said air collection chamber.

3. A hot water dispensing system according to claim 1 further comprising a controller for controlling energization of said heating element to heat the water in the tank to about 190° F. (88° C.) but not up to the boiling temperature of water.

4. A hot water dispensing system according to claim 1 wherein the water heating chamber and the expansion chamber are defined by walls composed of metal.

5. A hot water dispensing system according to claim 1 wherein the water heating chamber and the expansion chamber are defined by walls composed of plastic.

* * * * *